US008186782B2

(12) United States Patent
Choi

(10) Patent No.: US 8,186,782 B2
(45) Date of Patent: May 29, 2012

(54) DOOR APPARATUS OF REFRIGERATOR AND DAMPING APPARATUS OF THE SAME

(75) Inventor: Chang-Bong Choi, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 339 days.

(21) Appl. No.: 12/445,560

(22) PCT Filed: Oct. 30, 2007

(86) PCT No.: PCT/KR2007/005390

§ 371 (c)(1),
(2), (4) Date: Apr. 14, 2009

(87) PCT Pub. No.: WO2008/054115

PCT Pub. Date: May 8, 2008

(65) Prior Publication Data

US 2010/0084955 A1 Apr. 8, 2010

(30) Foreign Application Priority Data

Oct. 30, 2006 (KR) ..... 10-2006-0105781

(51) Int. Cl.
*A47B 96/04* (2006.01)

(52) U.S. Cl. ..... 312/405; 16/85

(58) Field of Classification Search ..... 312/404, 312/405, 109, 291, 292, 293.2, 327, 328, 312/319.2, 321.5; 49/61, 63, 142, 143, 386; 62/265, 441; 292/341.15, 179, DIG. 4; 16/68, 16/85, 82, 84

See application file for complete search history.

(56) References Cited

U.S. PATENT DOCUMENTS

| | | | | |
|---|---|---|---|---|
| 4,306,757 | A * | 12/1981 | Horvay et al. | 312/292 |
| 6,338,536 | B1 * | 1/2002 | Ueno et al. | 312/405 |
| 6,353,968 | B1 * | 3/2002 | Shyu et al. | 16/334 |
| 6,408,483 | B1 * | 6/2002 | Salice | 16/85 |
| 6,425,300 | B1 * | 7/2002 | Seo | 73/865.9 |
| 6,610,993 | B2 * | 8/2003 | Meyhofer et al. | 250/559.4 |
| 6,682,161 | B2 * | 1/2004 | Yun | 312/405 |
| 6,711,856 | B1 * | 3/2004 | Hoffman | 49/386 |
| 7,216,402 | B2 * | 5/2007 | Nishiyama et al. | 16/412 |
| 7,360,278 | B2 * | 4/2008 | Jang et al. | 16/357 |
| 7,669,285 | B2 * | 3/2010 | Gallasch et al. | 16/286 |
| 2002/0062533 | A1 * | 5/2002 | Huang | 16/50 |
| 2004/0178710 | A1 | 9/2004 | Kim et al. | |
| 2006/0282982 | A1 * | 12/2006 | Kim et al. | 16/221 |

FOREIGN PATENT DOCUMENTS

| | | | |
|---|---|---|---|
| CN | 1724891 | A | 1/2006 |
| GB | 2416380 | A * | 1/2006 |
| KR | 10-1998-0086404 | A | 12/1998 |
| KR | 10-2004-0080070 | A | 9/2004 |
| KR | 10-2006-0015156 | A | 2/2006 |

* cited by examiner

*Primary Examiner* — Korie H. Chan
(74) *Attorney, Agent, or Firm* — Birch, Stewart, Kolasch & Birch, LLP

(57) ABSTRACT

Disclosed are a door apparatus for a refrigerator and a damping apparatus for the same. The door apparatus for the refrigerator comprises: a main door for opening/closing the interior of a refrigerator, a sub-door for opening/closing the interior of the refrigerator through a portion of the main door, a sub-door frame disposed on the main door and supporting the sub-door, and a damper disposed at the sub-door frame to reduce an impact due to the pivotal movement of the sub-door. With a damping force required when the door is opened/closed and a more simplified structure of the door, a door design of higher tightness can be implemented.

12 Claims, 5 Drawing Sheets

[Fig. 1]
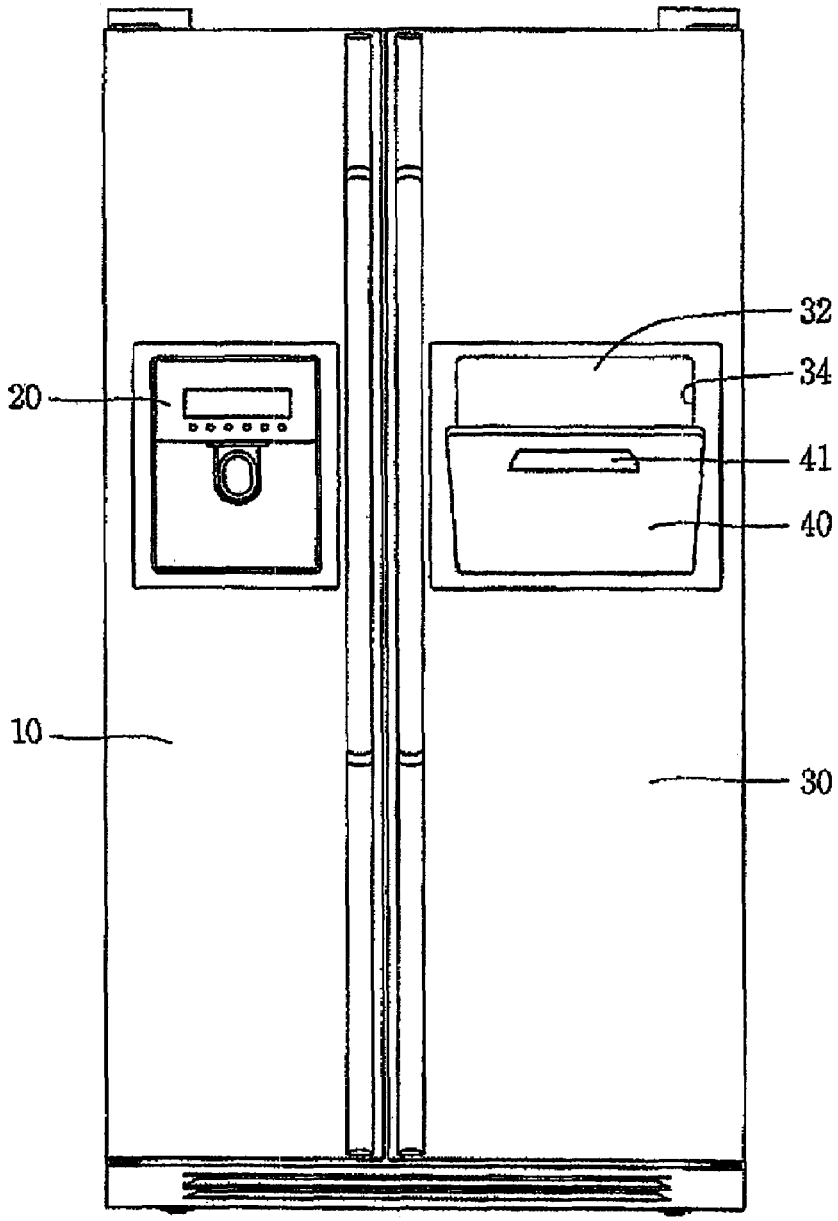

[Fig. 2]
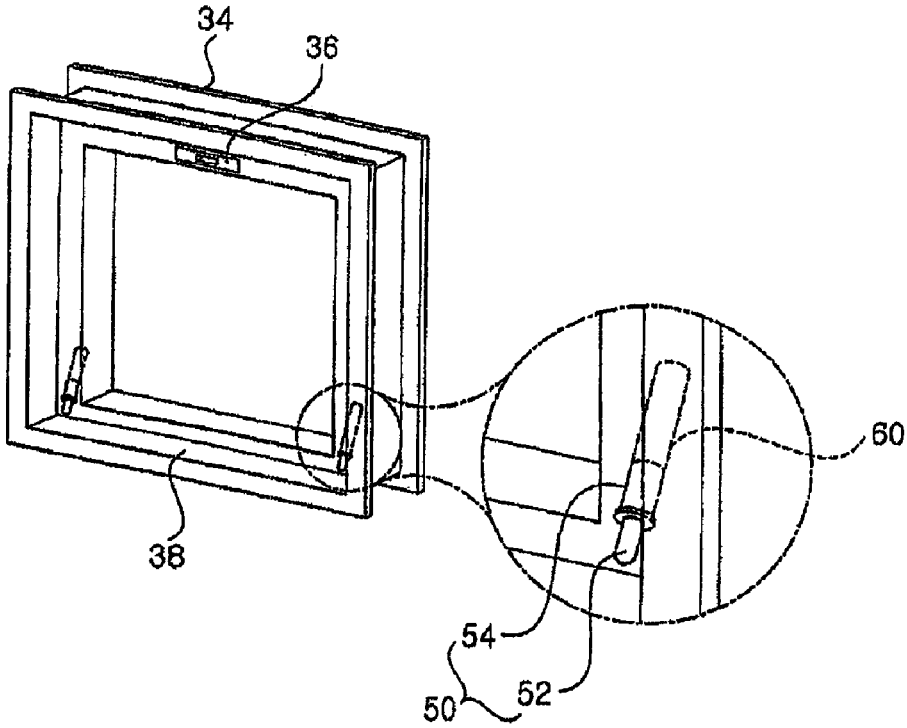
[Fig. 3]
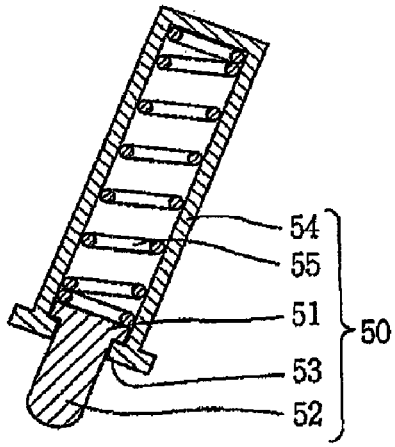

[Fig. 4]
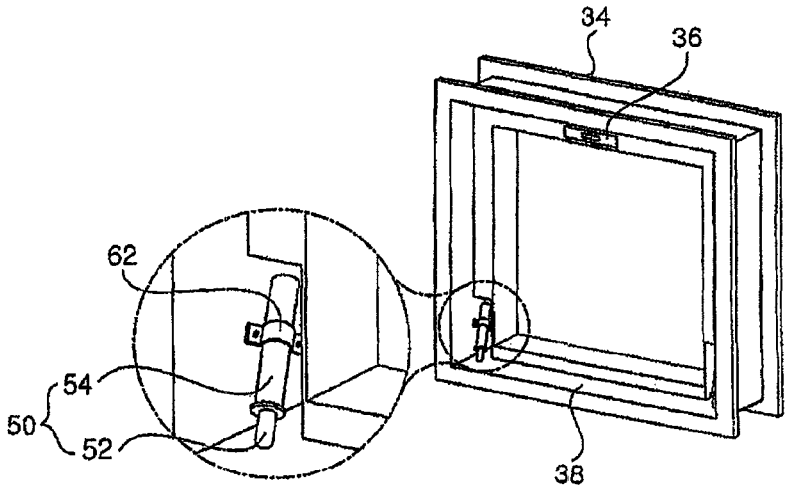
[Fig. 5]
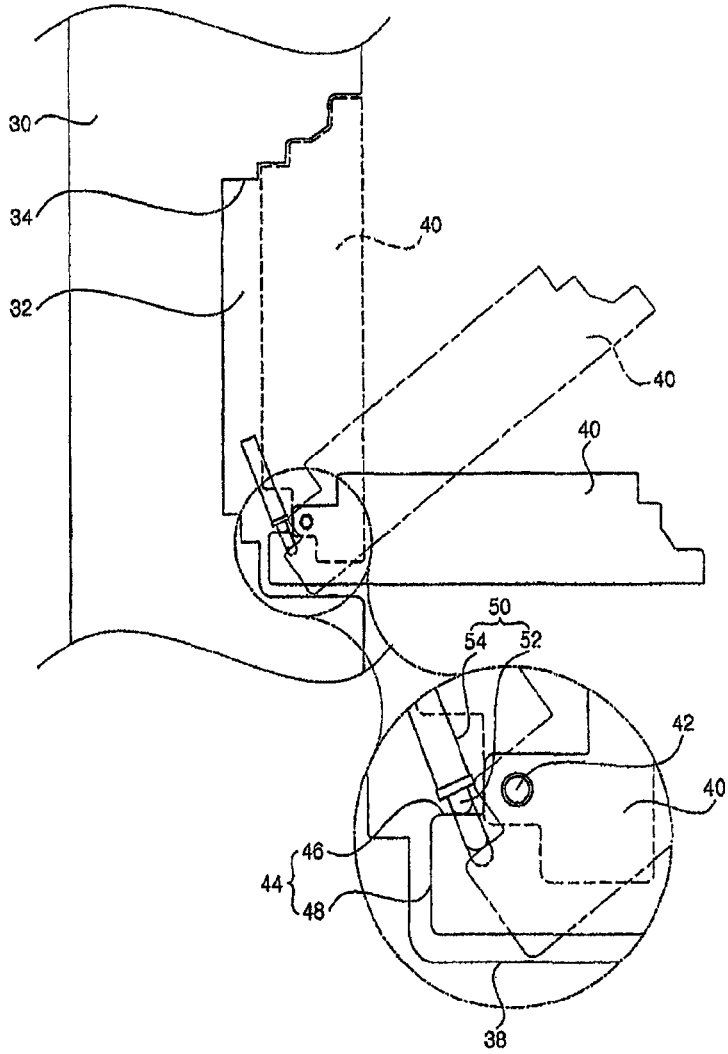

[Fig. 6]
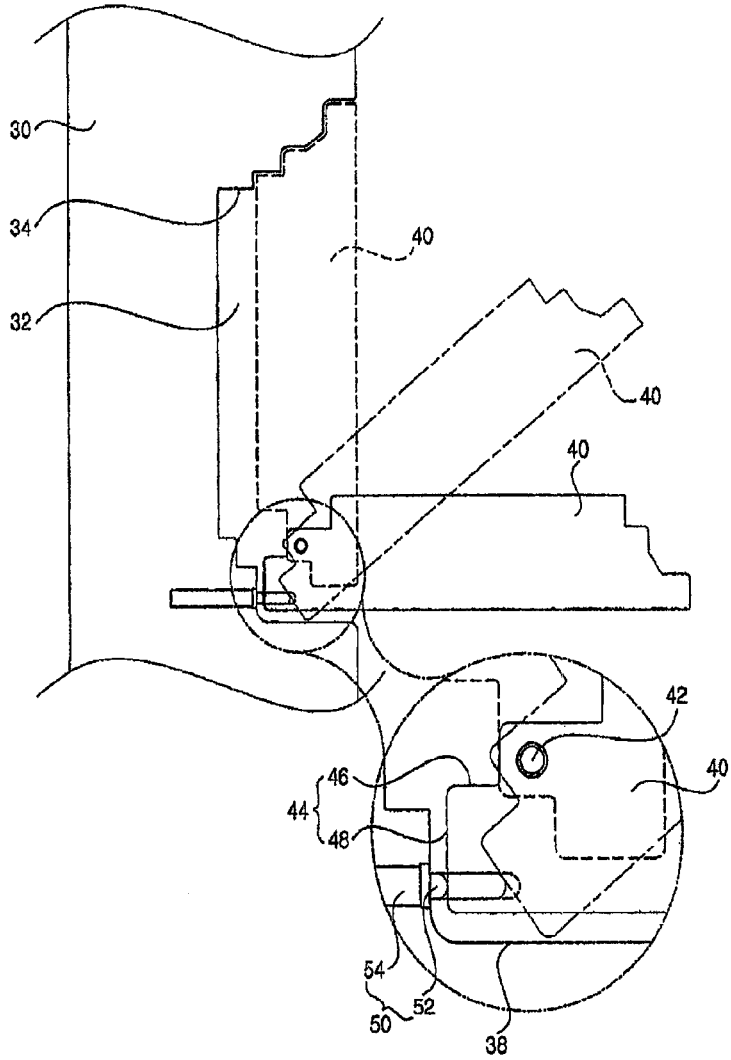
[Fig. 7]
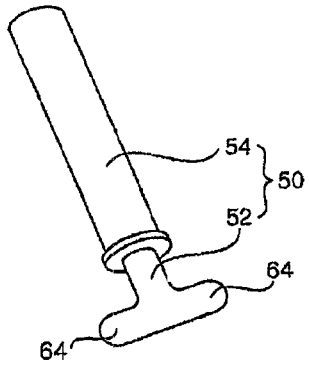

[Fig. 8]
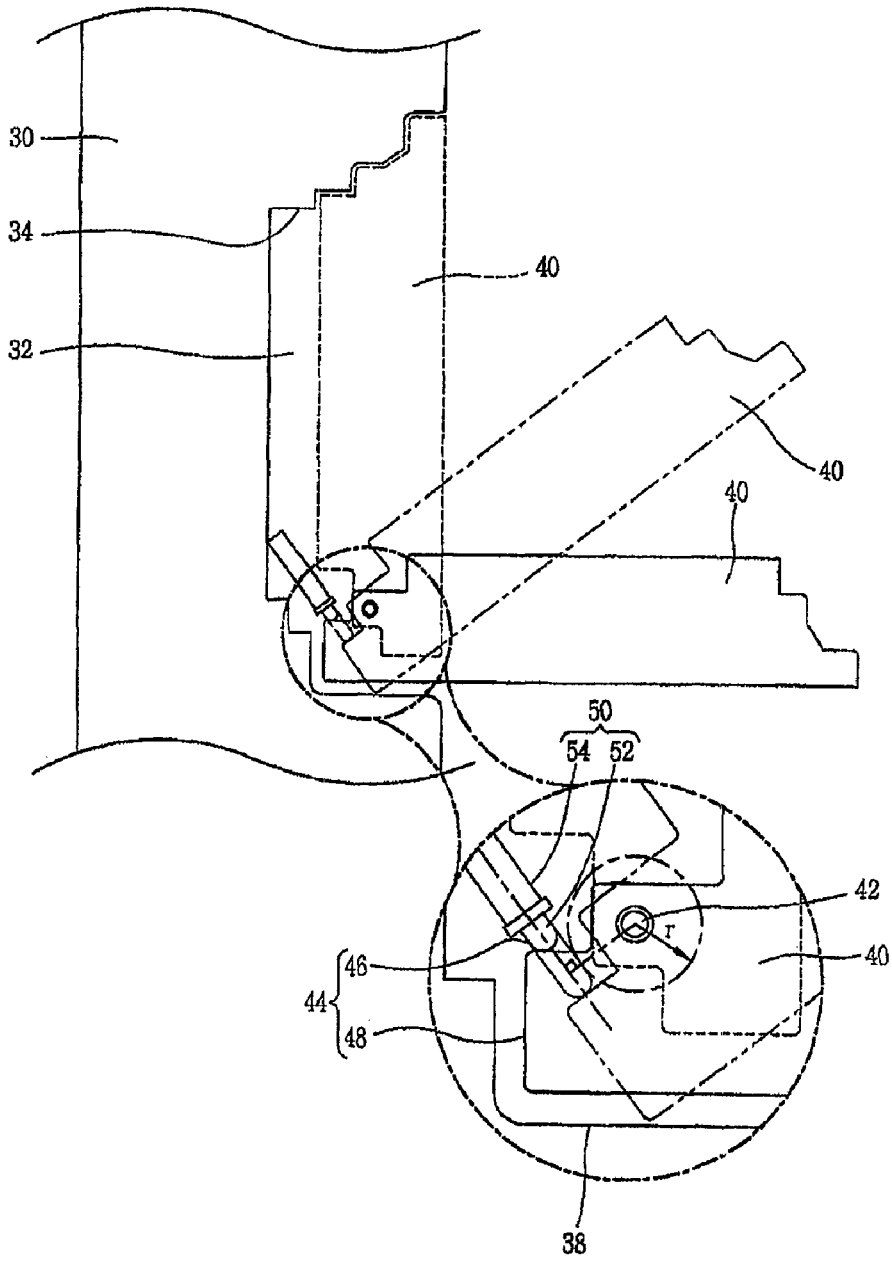

DOOR APPARATUS OF REFRIGERATOR AND DAMPING APPARATUS OF THE SAME

TECHNICAL FIELD

The present invention relates to a refrigerator, and more particularly, to a door apparatus for a refrigerator and a damping apparatus for the same.

BACKGROUND ART

With the introduction of a three-door refrigerator and a refrigerator equipped with a dispenser, sub-doors, etc., a recent trend of the refrigerator is for an increasing number of refrigerator doors according to its purpose and function.

As functions of a refrigerator are specialized to become subdivided, the number of customized doors tailor-made for a specific purpose is increasing. Accordingly, the doors are opened and closed in proportion to the increased number of the doors, thereby increasing an impact applied to a refrigerator main body. Therefore, there is a need to consider a shock absorber for the refrigerator door.

A related art refrigerator may include a main door for opening/closing the interior of the refrigerator, and a sub-door for opening/closing a portion of the main door. A lower end of the sub-door is pivotably coupled to the main door.

An impact and noise may occur when the sub-door is stopped while being pivoted to open/close the sub-door. To reduce such impact or noise, the related art refrigerator is provided with a damper inside the sub-door. In more detail, in the related art refrigerator, a damper is disposed inside the sub-door before expandable polystyrene (EPS) for filling inside the sub-door is injected into the sub-door, and then the expandable polystyrene (EPS) is injected.

Through such process, as the expandable polystyrene (EPS) gets hardened, the damper is fixed inside the sub-door.

However, according to the related art damper installation technique, since the damper is disposed inside the sub-door, the sub-door is thicker and a pivot mechanism of the sub-door becomes complicated.

DISCLOSURE OF THE INVENTION

Technical Problem

To overcome these problems and in accordance with the purposes of the present invention, as embodied and broadly described herein, there is provided a door apparatus for a refrigerator and a damping apparatus for the same, which can maintain a compact size of a sub-door and reduce an impact or noise occurring during an opening/closing operation of the sub-door.

To achieve this and other advantages and in accordance with the purpose of the present invention, as embodied and broadly described herein, there is provided a door apparatus for a refrigerator according to one aspect of the present invention, including: a main door for opening/closing the interior of a refrigerator, a sub-door for opening/closing the interior of the refrigerator through a portion of the main door, a sub-door frame disposed on the main door for supporting the sub-door, and a damper disposed on the sub-door frame to reduce an impact due to a pivotal movement of the sub-door.

A door apparatus for a refrigerator according to another aspect of the present invention includes: a main door for opening/closing the interior of a refrigerator, a sub-door frame disposed on the main door, a sub-door pivotally mounted at the sub-door frame for opening/closing the interior of the refrigerator through a portion of the main door, and a damper disposed on a pivotal path of the sub-door to reduce an impact according to a pivotal movement of the sub-door.

In a door apparatus for a refrigerator having a main door, a sub-door disposed at the main door so as to open a portion of the main door, and a sub-door frame disposed on the main door, a damping apparatus for a refrigerator door according to still another aspect of the present invention includes: a damper pressurizing unit disposed at the sub-door, and a damper positioned at the sub-door frame and pressurized by the damper pressurizing unit as the sub-door performs a pivotal movement so as to reduce an impact caused by the pivotal movement of the sub-door.

In a door apparatus for a refrigerator having a main door, a sub-door frame formed on the main door, and a sub-door pivotally mounted at the sub-door frame, a damping apparatus of a refrigerator door according to still another aspect of the present invention includes: a damper for reducing an impact according to a pivotal movement of the sub-door, and a damper mounting unit disposed on the sub-door frame so as to install the damper thereon.

A door apparatus for a refrigerator according to still another aspect of the present invention includes: a main door for opening/closing the interior of a refrigerator, a sub-door frame disposed on the main door and having a damper installing unit, a sub-door pivotally mounted at the sub-door frame so as to open/close the interior of the refrigerator through a portion of the main door, a damper pressurizing unit disposed at the sub-door, and a damper disposed at the damper mounting unit on a pivotal path of the sub-door and pressurized by the damper pressurizing unit as the sub-door performs a pivotal movement to reduce an impact according to the pivotal movement of the sub-door.

Effect of the Invention

The door apparatus for a refrigerator and the damping apparatus for the same according to one aspect of the present invention can reduce the impact and noise generated when the door is opened/closed by using the damper mounted at the frame, thereby making a thickness of the door thinner and simplifying a structure of the pivoting unit. That is, with a damping force required when the door is opened/closed and the more simplified structure of the door, a door design of higher tightness can be implemented.

BRIEF DESCRIPTION OF THE DRAWINGS

FIG. 1 is a front view showing the outer appearance of a refrigerator applying the present invention;

FIG. 2 is a perspective view showing a door apparatus for a refrigerator according to a first embodiment of the present invention;

FIG. 3 is a cross-sectional view showing a structure of a damper according to the present invention;

FIG. 4 is a perspective view showing a door apparatus for a refrigerator according to a second embodiment of the present invention;

FIG. 5 is a view showing opening/closing operations of a sub-door according to a third embodiment of the present invention;

FIG. 6 is a view showing opening/closing operations of a sub-door according to a fourth embodiment of the present invention;

FIG. 7 is a view showing a damper according to a fifth embodiment of the present invention; and FIG. 8 is a view showing opening/closing operations of a sub-door according to a sixth embodiment of the present invention.

MODES FOR CARRYING OUT THE PREFERRED EMBODIMENTS

Description will now be given in detail of the door apparatus for a refrigerator and a damping apparatus for the same according to the present invention, examples of which are illustrated in the accompanying drawings. The present invention may be applied to an overall refrigerator door. However, for the sake of convenience in explanation of the door apparatus of the refrigerator and the damping apparatus for the same, a sub-door for a refrigerator will be explained in detail.

FIG. 1 is a front view showing the outer appearance of a refrigerator applying the present invention. FIG. 2 is a perspective view showing a door apparatus for a refrigerator according to a first embodiment of the present invention, and FIG. 3 is a cross-sectional view showing a structure of a damper according to the present invention.

Referring to FIGS. 1 through 3, the refrigerator includes a freezing chamber door 10, and a cooling chamber door 30. Here, the freezing chamber door 10 and the cooling chamber door 30 may be defined as the main doors for opening/closing the interior of the refrigerator.

A dispenser 20 may be disposed at a portion of the freezing chamber door 10 for supplying purified water, ice, and the like.

A sub-door 40 is mounted at a portion of the cooling chamber door 30. The sub-door 40 is pivotably coupled to a sub-door frame 34 disposed at the cooling chamber door 30. The sub-door 40 is configured to open/close the interior of the refrigerator through a portion of the cooling chamber door 30, which is a main door.

Reference numeral 32 denotes a receiving unit inside the refrigerator which is opened/closed by the sub-door 40, and reference numeral 41 denotes a button helping a user to open/close the sub-door 40 by putting his hands thereon.

The sub-door frame 34 is disposed at one side of a front surface of the cooling chamber door 30 so as to form the receiving unit 32. And, the sub-door frame 34 is disposed at the main door to support the sub-door 40. A latch assembly 36 is provided at a front upper end of the sub-door frame 34.

The latch assembly 36 is connected with the button 41 disposed at the sub-door 40 and serves to open/close the sub-door 40. And, a stopping jaw 38 is disposed at a front lower end of the sub-door frame 34 to support the sub-door 40 or to prevent a pivoting movement of the sub-door 40 of excessive rotation angle.

Further, the sub-door 40 for opening/closing the receiving unit 32 in correspondence with the sub-door frame 34 is configured to pivot centering around a lower end of the sub-door 40 by being coupled to the sub-door frame 34 by a hinge 42.

Here, preferably, the lower end of the sub-door 40 is provided with multi-step(means) for a smooth pivotal movement of the sub-door 40. In particular, among the multi-step (means), a damper pressurizing unit 44 contacting the stopping jaw 38 is formed to be rounded. And, the damper pressurizing unit 44 includes, when the receiving unit 32 is shielded by the sub-door 40, an inner-side damper pressurizing unit 46 facing the inside of the receiving unit 32, and a lower-side damper pressurizing unit 48 extended from the inner-side damper pressurizing unit 46 and facing downward.

A damper 50 is disposed at the sub-door frame 34 for reducing an impact and noise generated when the sub-door 40 is open/closed. That is, the damper 50 is positioned on a pivotal path of the sub-door 40, thereby reducing an impact caused by the pivotal movement of the sub-door 40.

The damper 50 is provided with a damper body 54, an elastic member 55 disposed inside the damper body 54, such as a spring, etc., and a pressurized member 52 elastically supported by the elastic member 55 and to be pressurized by the damper pressurizing unit 44 formed at the sub-door frame 34.

The elastic member 55 may provide resistance for resisting against the pivoting movement of the sub-door 40 so as to reduce an impact by the pivoting movement of the sub-door 40.

The damper 50 is configured to be spaced from the sub-door 40 when the receiving unit 32 is shielded by the sub-door 40, and one end of the damper 50 is configured to contact the sub-door 40 when the receiving unit 32 is opened by the sub-door 40. The damper 50 includes the pressurized member 52 shaped as a round bar and performing a reciprocating motion by an external force.

Preferably, a tip of the pressurized member 52 is formed to have a gently curved surface, considering that the tip of the pressurized member 52 contacts the sub-door 40. And, one end of the pressurized member 52 is inserted into the inside of the damper body 54 having its insides sealed.

With such a construction, the operation of the door apparatus for the refrigerator and the damping apparatus for the same according to the present invention will now be described in detail.

First, FIG. 2 illustrates how the damper 50 is fixed to the sub-door frame 34.

As shown in FIG. 2, according to a first embodiment of the present invention, a damper insertion hole 60 is disposed in both sides of a lower end of the sub-door frame 34. When the sub-door frame 34 is injection molded, the damper insertion holes 60 are pre-formed considering the shape of the damper 50. Then, a damper 50 is inserted into each of the damper insertion holes 60, thereby being fixed to the sub-door frame 34.

Here, preferably, the number of the damper insertion holes 60 is formed in correspondence to the number of the dampers 50 required to reduce an impact which may be generated during opening/closing operations of the sub-door 40.

Hereinafter, description of other embodiments of the present invention will be given in detail with reference to the accompanying drawings. Explanations for the content that has already been described in the first embodiment are omitted.

FIG. 4 is a perspective view showing the door apparatus for a refrigerator according to a second embodiment of the present invention. FIG. 5 is a view showing opening/closing operations of the sub-door according to a third embodiment of the present invention. FIG. 6 is a view showing opening/closing operations of the sub-door according to a fourth embodiment of the present invention. FIG. 7 is a view showing a damper according to a fifth embodiment of the present invention, and FIG. 8 is a view showing opening/closing operations of the sub-door according to a sixth embodiment of the present invention.

Referring to FIG. 4, the dampers 50 according to the second embodiment of the present invention are fixed by fixing flanges 62, which are fixing members and are disposed at both lower sides of the sub-door frame 34.

The fixing flanges 62 serve to prevent a separation by closely contacting the damper body 54 to the sub-door frame 34. Various types of fixing flanges 62 may be used as long as they can fix the damper body 54.

Here, the damper insertion holes 60 and the fixing flanges 62 are configured to mount the dampers 50 to the sub-door frame 34, and can also be defined as damper mounting units.

Preferably, the damper mounting units are disposed at a lower portion of the sub-door frame 34. Preferably, in order to enhance load bearing power, at least two damper mounting units are disposed at locations corresponding to both sides of the sub-door frame 34, and each damper 50 is disposed inside a damper mounting unit.

Meanwhile, as shown in FIG. 5, the damper 50 according to a third embodiment of the present invention is fixed using the abovementioned method, etc. and disposed at the sub-door frame 34 while the pressurized member 52 is vertically oriented in a downward direction.

For the sake of convenience in explanation, there are three states: a state 'A' refers to when the sub-door 40 completely shields the receiving unit 32 (shown by a wavy line in the drawing), a state 'B' refers to when the sub-door 40 is pivoting (shown by a dashed dot chain line), and a state 'C' refers to when the sub-door 40 is completely open so that drinks, etc. may be taken out through the receiving unit 32 (shown in a solid line).

First, in the state 'A,' when the pressurized member 52 and the damper pressurizing unit 44 are spaced from each other, the sub-door 40 is supported by the stopping jaw 38 thus to shield the receiving unit 32.

However, if the user presses the button 41 of the sub-door 40, the sub-door 40 is pivoted centering around a shaft of the hinge 42. That is, the sub-door 40 turns to the state S' as the space between the pressurized member 52 and the damper pressurizing unit 44 becomes smaller, finally thus to contact each other.

Here, one end of the pressurized member 52 is pressurized by the inner-side damper pressurizing unit 46, and another end of the pressurized member 52 is inserted toward the damper body 54. And, resistance for preventing the insertion of the pressurized member 52 is generated inside the damper body 54.

Since the pressurized member 52 affected by the resistance contacts the inner-side damper pressurizing unit 46, it affects the pivotal movement of the sub-door 40. Accordingly, the pivotal speed due to the self-weight of the sub-door 40 starts to be reduced.

If the pivotal movement of the sub-door 40 continues to proceed, the one end of the pressurized member 52 is pressurized under the influence of more increasing force from the inner-side damper pressurizing unit 46, and the other end of the pressurized member 52 is inserted farther inside the damper body 54. To be certain, the pressurized member 52 receives greater resistance while being inserted farther toward the damper body 54. The pivotal speed due to the self-weight of the sub-door 40 is more reduced by such resistance.

And, if the sub-door 40 turns to the state 'C,' in which it is supported by the stopping jaw 38, unable to perform any more pivotal movement and thus to be stopped, the one end of the pressurized member 52 is the most greatly pressurized by the inner-side damper pressurizing unit 46.

Here, the pressurized member 52 is furthermost inserted inside the damper body 54, thereby causing the greatest resistance. This may minimize an impact, noise, etc. on the sub-door 40 which may occur when the sub-door 40 is stopped.

On the other hand, when the open sub-door 40 is pivoted in the reverse direction to the opening direction, as the pressing force of the inner-side damper pressurizing unit 46 is gradually reduced, the pressurized member 52 starts returning to its original state from its state inserted inside the damper body 54. Then, the pressurized member 52 is separated from the damper pressurizing unit 44 directly contacting thereto and then returns to the state 'A.'

That is, the sub-door 40 in this state is supported by the stopping jaw 38, the receiving unit 32 is shielded, and the pressurized member 52 and the damper pressurizing unit 44 are spaced from each other.

The damper pressurizing unit 44 may be disposed below the sub-door 40 centering around the shaft of the hinge 42. If the sub-door 40 is pivoted, the damper pressurizing unit 44 moves toward the inside of the main door.

Next, as shown in FIG. 6, the damper 50 according to a fourth embodiment of the present invention is mounted at the sub-door frame 34 such that the pressurized member 52 is horizontally disposed so as to face the sub-door 40.

First, in the state 'A,' similarly to the third embodiment, the sub-door 40 is supported by the stopping jaw 38 so as to shield the receiving unit 32, while the pressurized member 52 and the damper pressurizing unit 44 are spaced from each other.

If the user presses the button 41 of the sub-door 40, however, the sub-door 40 is pivoted centering around the shaft of the hinge 42. That is, the sub-door 40 turns to the state 'B,' as the space between the pressurized member 52 and the damper pressurizing unit 44 becomes smaller, finally thus to contact each other.

Here, the lower-side damper pressurizing unit 48 pressurizes the one end of the pressurized member 52, and the other end of the pressurized member 52 is inserted toward the damper body 54. And, resistance for preventing the insertion of the pressurized member 52 is generated inside the damper body 54.

Since the pressurized member 52 affected by the resistance contacts the lower-side damper pressurizing unit 48, it affects the pivotal movement of the sub-door 40. Accordingly, the pivotal speed due to the self-weight of the sub-door 40 starts to be reduced.

If the pivotal movement of the sub-door 40 continues to proceed, the one end of the pressurized member 52 is pressurized under the influence of more increasing force from the lower-side damper pressurizing unit 48, and the other end of the pressurized member 52 is inserted farther inside the damper body 54.

And, if the sub-door 40 turns to the state 'C,' in which it is supported by the stopping jaw 38, unable to perform any more pivotal movement and thus to be stopped, the one end of the pressurized member 52 is the most greatly pressurized by the lower-side damper pressurizing unit 48. And, the pressurized member 52 is furthermost inserted inside the damper body 54, thereby causing the greatest resistance. This may minimize an impact, noise, etc. on the sub-door 40 which may occur when the sub-door 40 is stopped.

Referring to FIG. 7, according to a fifth embodiment of the present invention, laterally extended portions 64 are disposed at a head portion of the pressurized member 52 contacting the sub-door 30. The head portion of the pressurized member 52 may be formed relatively larger than other portions thereof.

That is, by transforming the tip of the pressurized member 52 that performs the reciprocating movement due to an external force, when the sub-door 40 is pivoted, the pressurized member 52 can be pressurized by easily contacting the damper pressurizing unit 44.

The damper 50 having the laterally extended portions 64 is mounted at the sub-door frame 34 such that the damper 50 is spaced from the sub-door 40 when the sub-door 40 shields the receiving unit 32, and the one end of the damper 50 contacts the sub-door 40 when the sub-door 40 opens the receiving unit 32. The extended portions 64 of the thusly mounted damper 50 are pressed is by the pivotal movement of the sub-door 40 having a fixed pivotal angle. Accordingly, through the operations of the above-described embodiments, the impact or noise generated when opening/closing the sub-door 40 can be reduced.

As shown in FIG. 8, according to a sixth embodiment of the present invention, the sub-door frame 34 is formed with a damper insertion hole in a direction corresponding to the pivotal direction of the damper 50, and the damper 50 is disposed into the damper insertion hole.

The damper 50 is pressurized by the damper pressurizing unit 44 in a tangential direction on a circumference of a certain radius (r) centering around the shaft of the hinge 42. Then, the pressurizing force by the damper pressurizing unit 44 can be effectively transferred to the damper 50, thereby smoothing the operation of the damper 50.

As described so far, the door apparatus for a refrigerator and the damping apparatus for the same according to the present invention can reduce an impact and noise generated when the door is opened/closed by the damper mounted at the frame, thereby making a thickness of the door thinner and simplifying the structure of the pivoting unit. That is, with a damping force required when the door is opened/closed and the more simplified structure of the door, a door design of higher tightness can be implemented.

As the present invention may be embodied in several forms without departing from the spirit or essential characteristics thereof, it will be apparent to those skilled in the art that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, and equivalents of such metes and bounds are therefore intended to be embraced by the appended claims.

Applicability in Industry

According to the door apparatus for a refrigerator and the damping apparatus for the same according to one aspect of the present invention, the size of the door is compact and an impact by the pivotal movement thereof can be absorbed, thereby having high industrial applicability.

What is claimed is:

1. A door apparatus for a refrigerator, comprising:

a main door for opening/closing an interior of a refrigerator;

a sub-door for opening/closing the interior of the refrigerator through a portion of the main door;

a sub-door frame disposed on the main door for supporting the sub-door;

a damper pressurizing unit disposed at the sub-door; and a damper positioned at the sub-door frame and pressurized by the damper pressurizing unit as the sub-door performs a pivotal movement so as to reduce an impact according to the pivotal movement of the sub-door, wherein the sub-door is pivoted centering around a hinge shaft by being coupled to the sub-door frame by a hinge, and the damper pressurizing unit is disposed below the sub-door centering around the hinge shaft, wherein the damper includes a damper body, an elastic member disposed inside the damper body, and a pressurized member elastically supported by the elastic member and pressurized by the damper pressurizing unit, wherein the damper pressurizing unit includes an inner-side damper pressurizing unit facing the interior of the refrigerator and a lower-side damper pressurizing unit extending from the inner-side damper pressurizing unit and facing downward when the sub-door is closed, wherein the damper is spaced from the sub-door when the sub-door is closed, and one end of the damper contacts the sub-door when the sub-door is opened, and wherein the damper is disposed at the sub-door frame while the pressurized member is vertically oriented in a downward direction.

2. The apparatus of claim 1, wherein the damper pressurizing unit is disposed on a rear surface of the sub-door.

3. The apparatus of claim 1, wherein if the sub-door is pivoted to open a portion of the main door, the damper pressurizing unit moves toward an inside of the main door.

4. The apparatus of claim 1, wherein the damper is pressurized by the damper pressurizing unit in a tangential direction on a circumference of a certain radius centering around the shaft of the hinge.

5. The apparatus of claim 1, wherein a head portion of the pressurized member contacting the damper pressurizing unit is formed relatively larger than other portions thereof.

6. The apparatus of claim 1, further comprising:

a damper mounting unit disposed on the sub-door frame so as to install the damper thereon.

7. The apparatus of claim 6, wherein the damper mounting unit includes a damper insertion hole disposed in the sub-door frame.

8. The apparatus of claim 7, wherein the damper insertion hole is formed in a direction corresponding to a pivotal direction of the damper.

9. The apparatus of claim 6, wherein the damper mounting unit is disposed at a lower portion of the sub-door frame.

10. The apparatus of claim 6, wherein at least two damper mounting units are disposed in locations corresponding to both sides of the sub-door frame.

11. The apparatus of claim 6, wherein the damper mounting unit includes a fixing member for fixing the damper to the sub-door frame.

12. A door apparatus for a refrigerator, comprising:

a main door for opening/closing an interior of a refrigerator;

a sub-door frame disposed on the main door and having a damper installing unit;

a sub-door pivotally mounted at the sub-door frame so as to open/close the interior of the refrigerator through a portion of the main door;

a damper pressurizing unit disposed at the sub-door; and a damper disposed at the damper mounting unit on a pivotal path of the sub-door and pressurized by the damper pressurizing unit as the sub-door performs a pivotal movement so as to reduce an impact due to the pivotal movement of the sub-door, wherein the sub-door is pivoted centering around a hinge shaft by being coupled to the sub-door frame by a hinge, and the damper pressurizing unit is disposed below the sub-door centering around the hinge shaft, wherein the damper includes a damper body, an elastic member disposed inside the damper body, and a pressurized member elastically supported by the elastic member and pressurized by the damper pressurizing unit, wherein the damper pressurizing unit includes an inner-side damper pressurizing unit facing the interior of the refrigerator and a lower-side damper pressurizing unit extending from the inner-side damper pressurizing unit and facing downward when the sub-door is closed, wherein the damper is spaced from the sub-door when the sub-door is closed, and one end of the damper contacts the sub-door when the sub-door is opened, and wherein the damper is disposed at the sub-door frame while the pressurized member is vertically oriented in a downward direction.

* * * * *